US011882891B1

(12) United States Patent
Burnsed, Jr.

(10) Patent No.: US 11,882,891 B1
(45) Date of Patent: Jan. 30, 2024

(54) BELT

(71) Applicant: Blue Force Gear, Inc., Pooler, GA (US)

(72) Inventor: Ashley A Burnsed, Jr., Savannah, GA (US)

(73) Assignee: Blue Force Gear, Inc., Pooler, GA (US)

( * ) Notice: Subject to any disclaimer, the term of this patent is extended or adjusted under 35 U.S.C. 154(b) by 134 days.

(21) Appl. No.: 17/227,701

(22) Filed: Apr. 12, 2021

Related U.S. Application Data

(60) Provisional application No. 63/010,001, filed on Apr. 14, 2020.

(51) Int. Cl.
*A41F 9/02* (2006.01)
*A41F 9/00* (2006.01)
*A44B 11/00* (2006.01)

(52) U.S. Cl.
CPC ..... *A41F 9/002* (2013.01); *A44B 11/005* (2013.01)

(58) Field of Classification Search
CPC ..... A41B 11/22; A41B 11/20; A41B 11/005; A41B 11/002
See application file for complete search history.

(56) References Cited

U.S. PATENT DOCUMENTS 1,856,776 A * 5/1932 Mcdermott ..... A44B 11/226 24/180
2,419,662 A * 4/1947 Sutton ..... A44B 11/22 24/177
2,548,200 A * 4/1951 Critchley ..... A44B 11/22 2/322
2,783,516 A * 3/1957 Stein ..... A44B 11/22 D11/231
3,913,147 A * 10/1975 Ostrander ..... A44B 11/22 2/325
5,127,136 A * 7/1992 Magnus ..... A44B 11/226 24/177
6,412,148 B1 * 7/2002 Morris ..... A44B 11/22 24/177
10,568,392 B2 * 2/2020 Swaggart ..... A44B 11/22
10,973,269 B2 * 4/2021 Moritz ..... A41F 9/00
2011/0072560 A1 * 3/2011 Valdez ..... A41F 9/002 24/3.1

(Continued)

FOREIGN PATENT DOCUMENTS

EP 3247236 B1 * 10/2021 ..... A41F 9/002

*Primary Examiner* — Richale L Quinn
(74) *Attorney, Agent, or Firm* — Merchant & Gould P.C.

(57) ABSTRACT

Belts have an elongated portion having opposed first and second ends configured for connection to each other, the first end including a planar body defining a first aperture and a second aperture spaced apart from the first aperture, and the second end including a buckle having a body with a first protrusion configured to be received in the first aperture and a second protrusion configured to be received in the second aperture. The first end may have a first free end. The second aperture may be closer to the first free end than is the first aperture. The second end may have a second free end. The first protrusion may be closer to the second free end than is the second protrusion. The first aperture may have a first limit surface away from the second aperture. The second aperture may have a second limit surface away from the first aperture.

24 Claims, 6 Drawing Sheets

(56) References Cited

U.S. PATENT DOCUMENTS

| | | | | |
|---|---|---|---|---|
| 2016/0227859 | A1* | 8/2016 | Burri | A41F 9/002 |
| 2018/0035763 | A1* | 2/2018 | Kumuchian | A44B 11/22 |
| 2018/0279723 | A1* | 10/2018 | Swaggart | A44B 11/22 |
| 2018/0279726 | A1* | 10/2018 | Hwang | A45B 7/00 |
| 2019/0191824 | A1* | 6/2019 | Cuthbert | A44B 11/22 |

* cited by examiner

BELT

CROSS-REFERENCE TO RELATED APPLICATION

This application claims the benefit of U.S. Provisional Patent Application No. 63/010,001 filed on Apr. 14, 2020, entitled "RANGE BELT BUCKLE," which is hereby incorporated by reference in its entirety for all that is taught and disclosed therein.

FIELD OF THE INVENTION

The present invention relates to load carriers, and more particularly to a belt that enables a user to carry a variety of loads without the weight, bulk, and cost of a two-piece buckle.

BACKGROUND OF THE INVENTION

Range belts enable a wearer to carry a variety of loads, including holsters, spare magazines in carriers, and assorted pouches. Prior art range belts exist that include an inner belt that is threaded through the wearer's belt loops and an outer belt that is releasably secured to the inner belt using hook and loop fasteners. The inner belt can typically be used without the outer belt as a regular belt when desired. While functional buckles exist for prior art range belts, these conventional buckles are two-piece designs. The required opposing connecting buckle piece adds undesirable weight, bulk, and cost to the associated range belt. Furthermore, additional hardware pieces may be required to enable to user to adjust the sizing of the range belt.

Therefore, a need exists for a new and improved belt that combines adjustment for the sizing of the belt with a one-piece buckle. In this regard, the various embodiments of the present invention substantially fulfill at least some of these needs. In this respect, the belt according to the present invention substantially departs from the conventional concepts and designs of the prior art, and in doing so provides an apparatus primarily developed for the purpose of combines adjustment for the sizing of the belt with a one-piece buckle.

SUMMARY OF THE INVENTION

The present invention provides an improved belt, and overcomes the above-mentioned disadvantages and drawbacks of the prior art. As such, the general purpose of the present invention, which will be described subsequently in greater detail, is to provide an improved belt that has all the advantages of the prior art mentioned above.

To attain this, the preferred embodiment of the present invention essentially comprises an elongated portion having opposed first and second ends configured for connection to each other, the first end including a planar body defining a first aperture and a second aperture spaced apart from the first aperture, and the second end including a buckle having a body with a first protrusion configured to be received in the first aperture and a second protrusion configured to be received in the second aperture. The first end may have a first free end. The second aperture may be closer to the first free end than is the first aperture. The second end may have a second free end. The first protrusion may be closer to the second free end than is the second protrusion. The first aperture may have a first limit surface away from the second aperture. The second aperture may have a second limit surface away from the first aperture. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
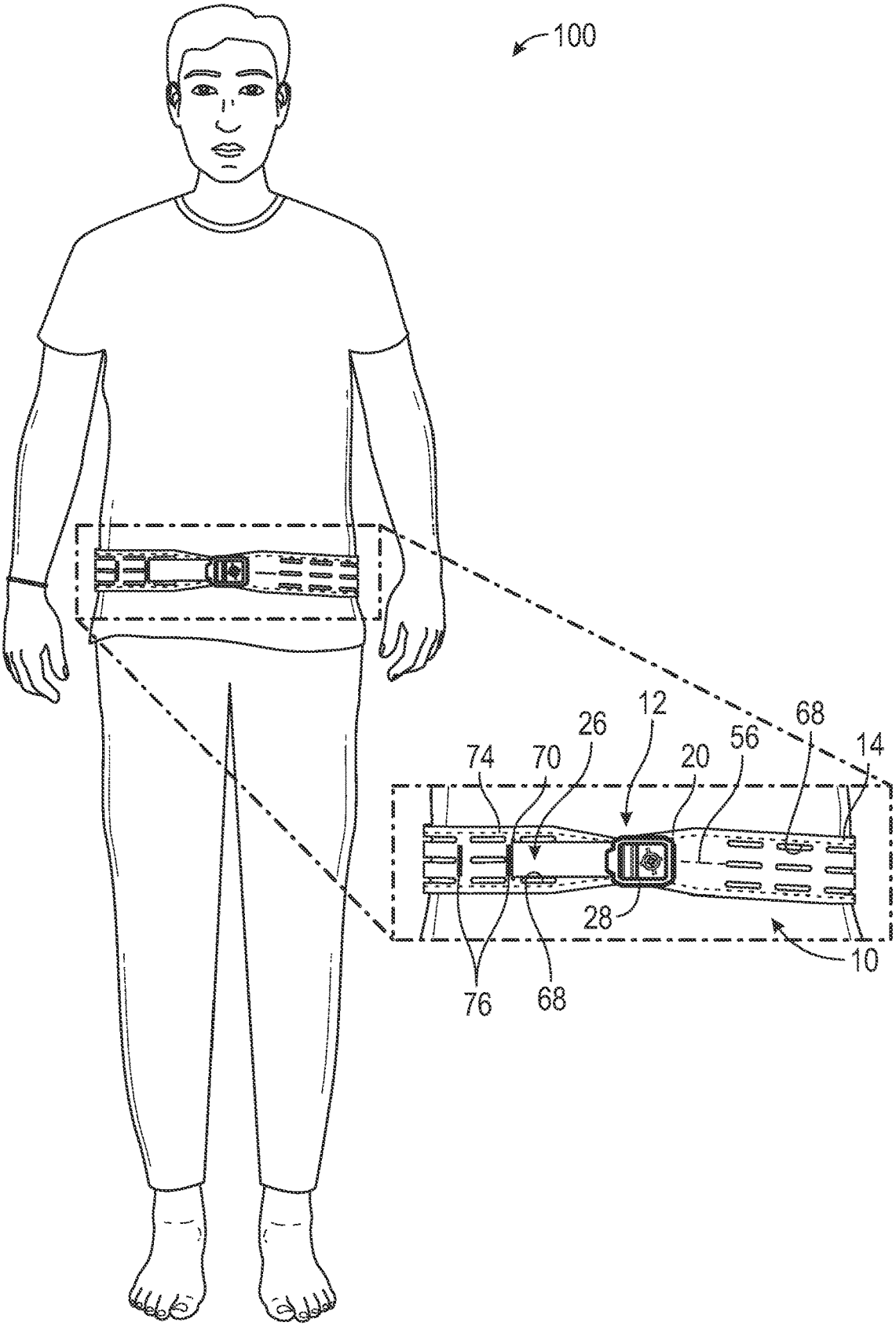
FIG. 1 is a front view of the current embodiment of a belt constructed in accordance with the principles of the present invention in use being worn by a person.

An embodiment of the belt of the present invention is shown and generally designated by the reference numeral 10.

Figure 2A:
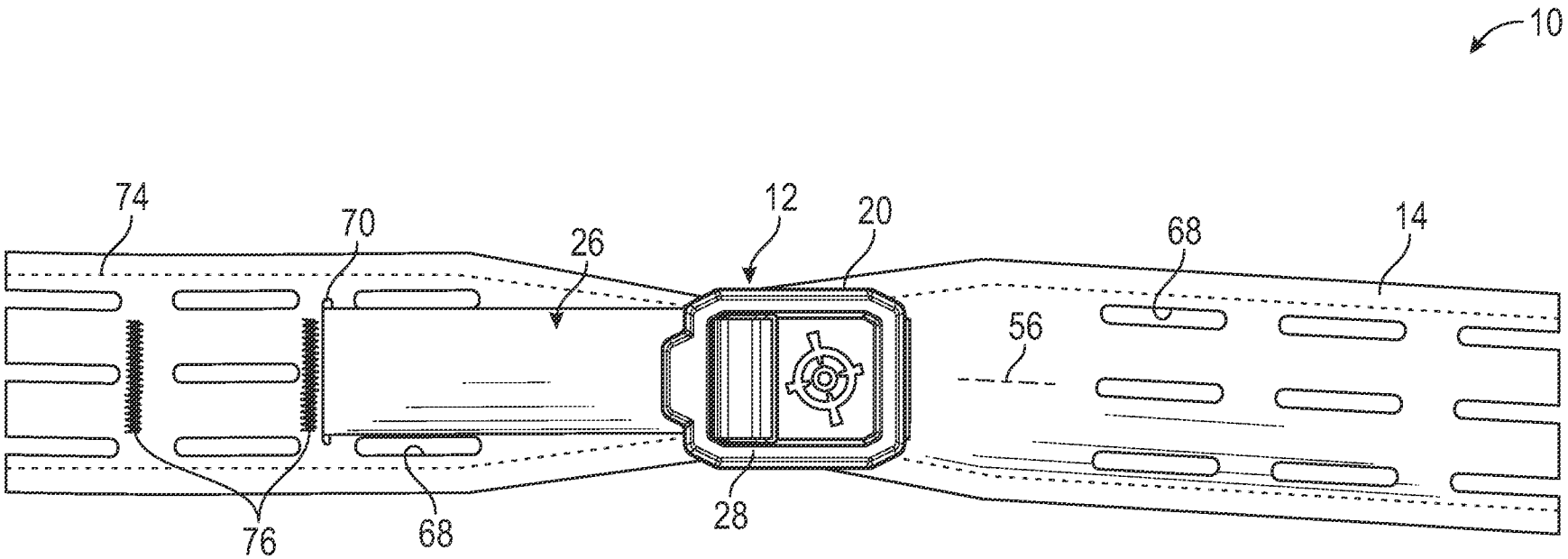
FIG. 2A is an enlarged front view of the belt of FIG. 1.
Figure 2B:
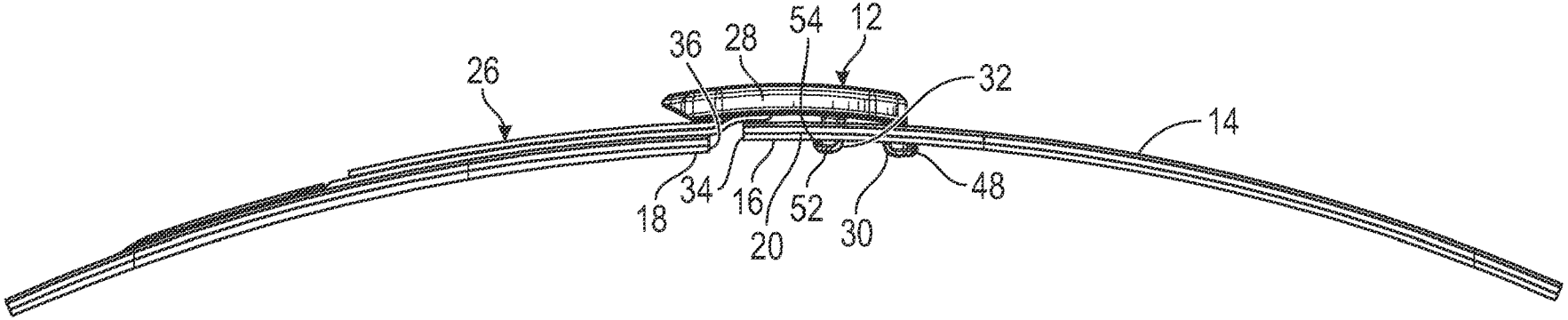
FIG. 2B is an enlarged side view of the belt of FIG. 1.
Figure 2C:
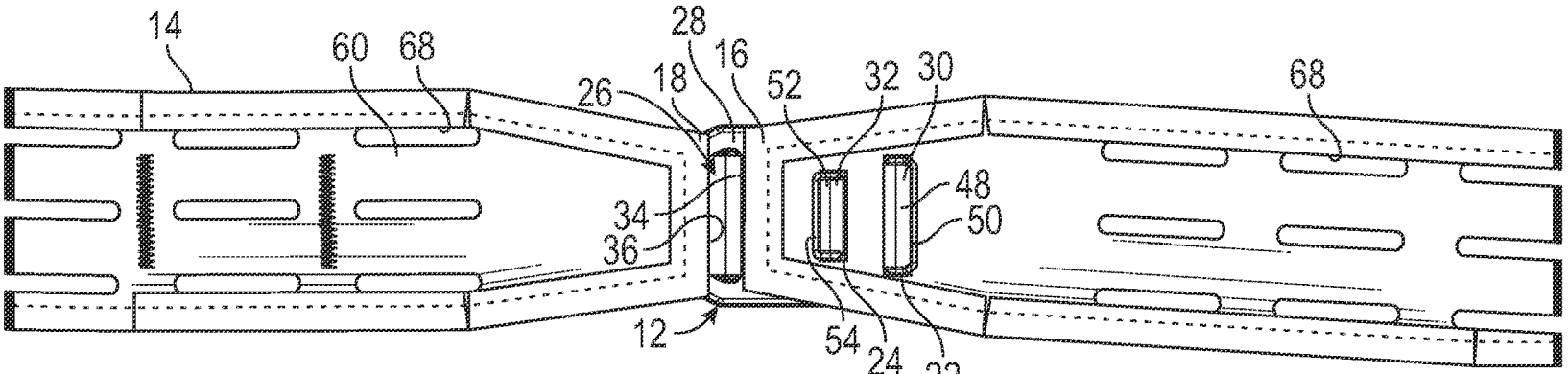
FIG. 2C is an enlarged back view of the belt of FIG. 1.
Figure 3B:
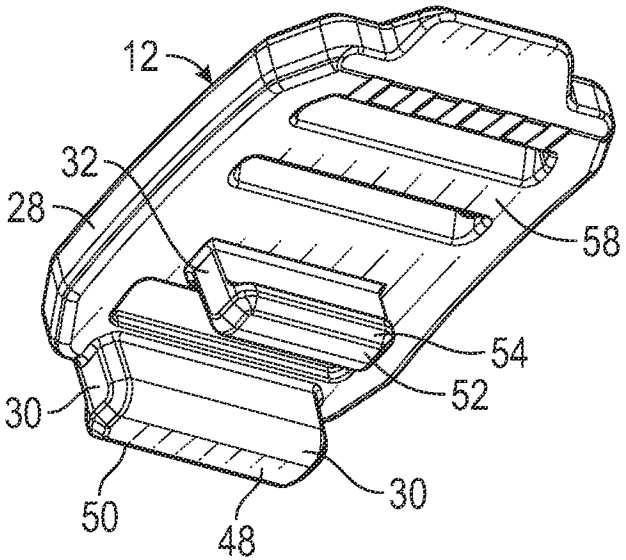
FIG. 3B is a rear isometric view of the buckle of FIG. 1 detached from the belt.
Figure 3A:
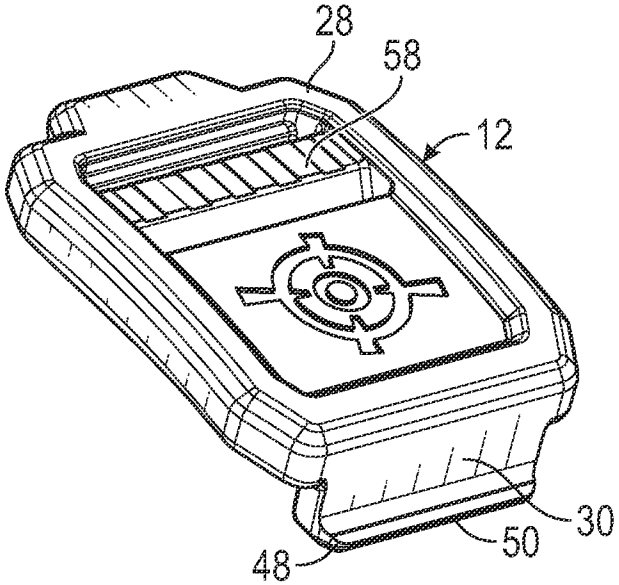
FIG. 3A is a front isometric view of the buckle of FIG. 1 detached from the belt.

FIG. 1-2C illustrate the improved belt 10 of the present invention, and FIGS. 3A-B illustrate the improved buckle 12 of the present invention. More particularly, FIG. 1 shows the belt in use being worn by a person 100, and FIGS. 3A-B show the buckle detached from the belt. The belt has an elongated portion 14 having opposed first and second ends 16, 18 configured for connection to each other. The first end includes a planar body 20 defining a first aperture 22 and a second aperture 24 spaced apart from the first aperture. The first and second apertures are rectangular in the current embodiment.

The second end 18 includes a buckle 12 having a body 28 with a first protrusion 30 configured to be received in the first aperture 22 and a second protrusion 32 configured to be received in the second aperture 24. The first end 16 has a first free end 34, and the second aperture is closer to the first free end than is the first aperture in the current embodiment. The second end 18 has a second free end 36, and the second protrusion is closer to the second free end than is the first protrusion in the current embodiment. The first aperture has a first limit surface 38 away from the second aperture (visible in FIGS. 4A-C). The second aperture has a second limit surface 40 away from the first aperture (visible in FIGS. 4A-C). The distance between the first limit surface and the second limit surface defines an aperture gap 42. The first and second protrusions extend in a common direction away from the body of the buckle.

The first protrusion 30 has a first stop surface 44 facing away from the second protrusion 32 and adjacent to the body 28 of the buckle 12. The second protrusion has a second stop surface 46 facing away from the first protrusion and adjacent to the body of the buckle. The distance between the first and second stop surfaces defines a protrusion span 80, with the protrusion span being less than the aperture gap 42. The first protrusion has a free end with a first nose 48 extending away from the second protrusion and having a first nose free end 50, and the second protrusion having a second nose 52 extending away from the first protrusion and having a second nose free end 54. In the current embodiment, the distance between the first nose free end and the second stop surface is less than the aperture gap, and the distance between the second nose free end and the first stop surface is less than the aperture gap. The first and second noses extend in opposite directions. The belt defines a primary axis 56, and the first and second limit surfaces are perpendicular to the primary axis. The buckle includes a strap mounting facility 58 (visible in FIGS. 3A-B and 4A-C) spaced apart from the first protrusion with the second protrusion therebetween.

The elongated portion 14 of the belt 10 has an inner surface including a hook and loop fastener component 60, such that an inner belt 62 (shown in FIGS. 4A-C) having an external compatible hook and loop fastener component 64 and a bottom flexible laminated element 78 is removably engaged to the inner surface. The elongated portion includes a flexible laminated element 66. The flexible laminated element defines a plurality of equipment mounting apertures 68 configured to mount equipment. The flexible laminated element also defines the first and second apertures in the current embodiment. A middle layer 72 made of thermoplastic composite fabric in the current embodiment is sandwiched between the flexible laminated element and the inner surface. The middle layer also partially defines the plurality of equipment mounting apertures and the first and second apertures. The flexible laminated element, middle layer, and hook and loop fastener component are secured together by stitching 74. The addition of the inner belt makes the belt very rigid. This is especially preferential for carrying a sidearm in a holster because the belt creates a very stable mounting surface when worn.

Figure 4A:
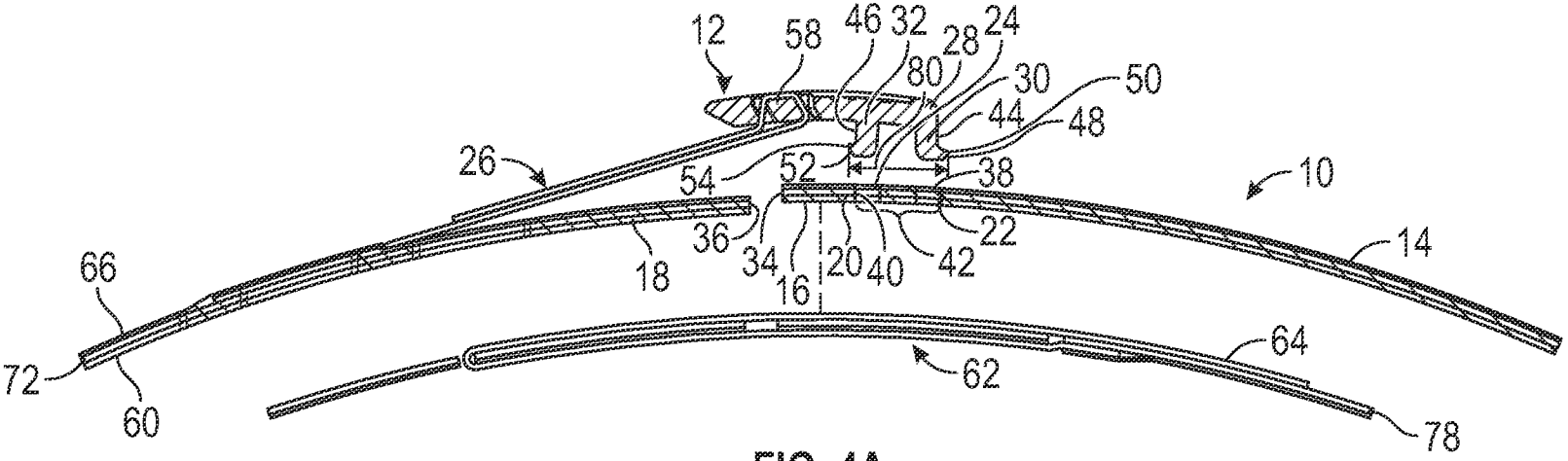
FIG. 4A is a side sectional exploded view of the belt of FIG. 1 showing the first step of the buckle fastening sequence.
Figure 4B:
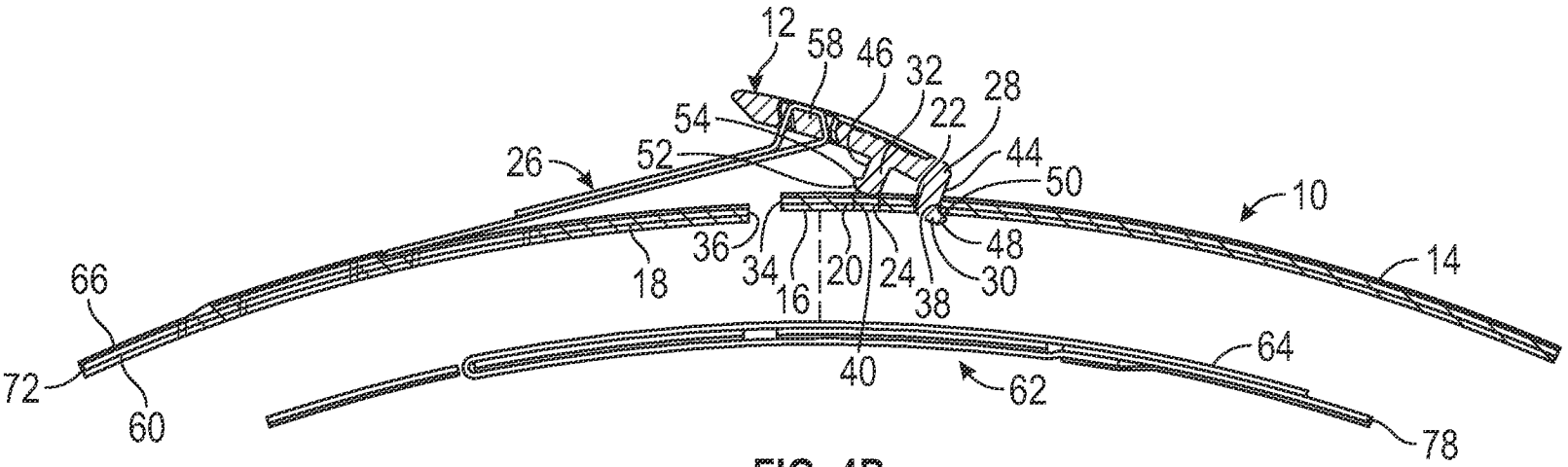
FIG. 4B is a side sectional exploded view of the belt of FIG. 1 showing the second step of the buckle fastening sequence.
Figure 4C:
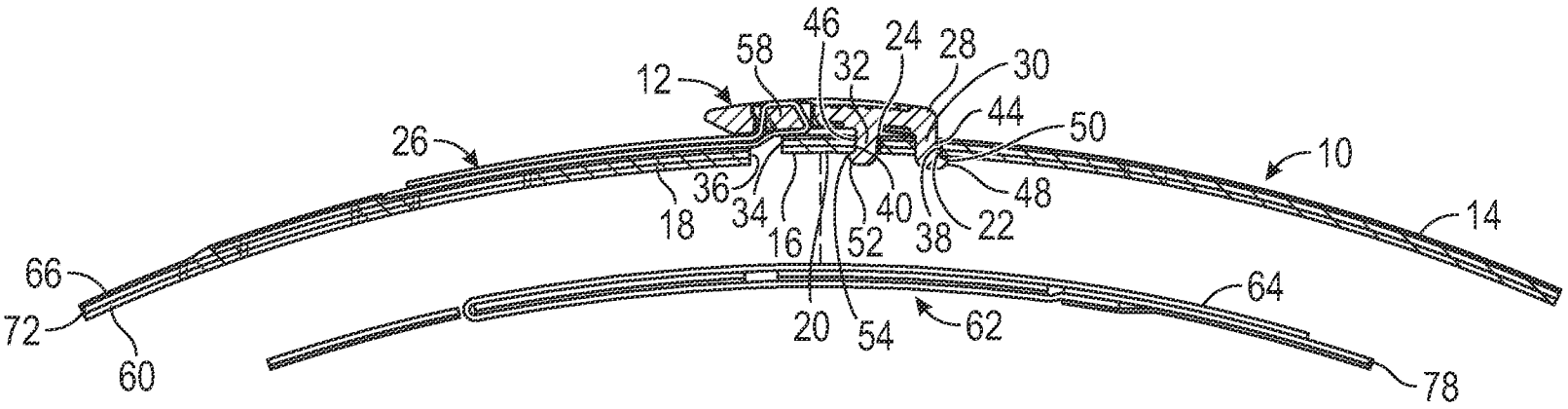
FIG. 4C is a side sectional exploded view of the belt of FIG. 1 showing the third step of the buckle fastening sequence.

FIG. 4A-C illustrate the improved belt 10 of the present invention. More particularly, FIG. 4A shows the first step of the buckle fastening sequence that releasably connects the buckle to the planar body 20 on the first end 16 of the belt, FIG. 4B shows the second step of the buckle fastening sequence, and FIG. 4C shows the third step of the buckle fastening sequence. In the first step, the wearer locates the buckle 12 so the first protrusion 30 is above the first aperture 22 and the second protrusion 32 is above the second aperture 24. In the second step, the wearer tilts the buckle forward and inserts the first nose 48 through the first aperture so the first nose free end extends beyond the first aperture and beneath the belt to releasably secure the first protrusion within the first aperture. In the third step, the wearer tilts the buckle backward and inserts the second nose 50 through the second aperture so the second nose free end 54 extends beyond the second aperture and beneath the belt to releasably secure the second protrusion within the second aperture. The opposed directions of the first and second nose free ends prevent the first and second protrusions from being inserted incorrectly into the first and second apertures. In an optional fourth step, the wearer can tighten or loosen a strap 26 passed around the strap mounting facility 58 to adjust the fit of the belt. A strap slot 70 (visible in FIG. 2A) formed by a loop of laminated material receives a free end (not visible) of the strap after any fit adjustments are made. An opposed end of the strap (not visible) is secured to the belt by two bar tack stitches 76 (visible in FIG. 2A). Steps 1-3 are reversed when the wearer wishes to detach the buckle from the planar body on the first end of the belt. In the current embodiment, the strap is made of 1 inch wide nylon webbing, and the buckle is made of 10% glass-filled Nylon 66.

While a current embodiment of a belt has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A belt for securing about a wearer's waist comprising:

an elongated portion having opposed first and second ends configured for connection to each other;

the first end including a planar body defining a first aperture and a second aperture spaced apart from the first aperture;

the first and second apertures being in a common plane;

the second end including a buckle having a body with a first protrusion configured to be received in the first aperture and a second protrusion configured to be received in the second aperture; and wherein the first end has a first free end, and the second aperture is closer to the first free end than is the first aperture, and wherein the second end has a second free end, and the second protrusion is closer to the second free end than is the first protrusion.

2. The belt of claim 1 wherein the first aperture has a first limit surface away from the second aperture, the second aperture has a second limit surface away from the first aperture, the distance between the first limit surface and the second limit surface comprising an aperture gap;

wherein the first and second protrusions extend in a common direction away from the body of the buckle, and the first protrusion having a first stop surface facing away from the second protrusion and adjacent to the body, the second protrusion having a second stop surface facing away from the first protrusion and adjacent to the body, the distance between the first and second stop surfaces defining a protrusion span; and the protrusion span being less than the aperture gap.

3. The belt of claim 2 wherein the first protrusion has a free end with a first nose extending away from the second protrusion and having a first nose free end, and the second protrusion having a second nose extending away from the first protrusion and having a second nose free end.

4. The belt of claim 3 including the distance between the first nose free end and the second stop surface being less than the aperture gap.

5. The belt of claim 3 the distance between the second nose free end and the first stop surface being less than the aperture gap.

6. The belt of claim 3 wherein the first and second noses extend in opposite directions.

7. The belt of claim 2 wherein the belt defines a primary axis, and the first and second limit surfaces are perpendicular to the primary axis.

8. The belt of claim 1 wherein the buckle includes a strap mounting facility spaced apart from the first protrusion with the second protrusion therebetween.

9. The belt of claim 1 wherein the elongated portion has an inner surface including a hook and loop fastener component, such that an inner belt having an external compatible hook and loop fastener component is removably engaged.

10. The belt of claim 1 wherein the elongated portion includes a flexible laminated element.

11. The belt of claim 10 wherein the flexible laminated element defines a plurality of equipment mounting apertures configured to mount equipment.

12. The belt of claim 10 wherein the flexible laminated element defines the first and second apertures.

13. A belt for securing about a wearer's waist comprising:

an elongated portion having opposed first and second ends configured for connection to each other;

the first end including a planar body defining a first aperture and a second aperture spaced apart from the first aperture;

the first aperture and second apertures being adjacent to each other when the belt is in an unsecured condition;

the second end including a buckle having a body with a first protrusion configured to be received in the first aperture and a second protrusion configured to be received in the second aperture, and wherein the first end has a first free end, and the second aperture is closer to the first free end than is the first aperture, and wherein the second end has a second free end, and the second protrusion is closer to the second free end than is the first protrusion.

14. The belt of claim 13 wherein the first aperture has a first limit surface away from the second aperture, the second aperture has a second limit surface away from the first aperture, the distance between the first limit surface and the second limit surface comprising an aperture gap;

wherein the first and second protrusions extend in a common direction away from the body of the buckle, and the first protrusion having a first stop surface facing away from the second protrusion and adjacent to the body, the second protrusion having a second stop surface facing away from the first protrusion and adjacent to the body, the distance between the first and second stop surfaces defining a protrusion span; and the protrusion span being less than the aperture gap.

15. The belt of claim 14 wherein the first protrusion has a free end with a first nose extending away from the second protrusion and having a first nose free end, and the second protrusion having a second nose extending away from the first protrusion and having a second nose free end.

16. The belt of claim 13 wherein the buckle includes a strap mounting facility spaced apart from the first protrusion with the second protrusion therebetween.

17. The belt of claim 13 wherein the elongated portion has an inner surface including a hook and loop fastener component, such that an inner belt having an external compatible hook and loop fastener component is removably engaged.

18. The belt of claim 13 wherein the elongated portion includes a flexible laminated element.

19. A belt for securing about a wearer's waist comprising:

an elongated portion having opposed first and second ends configured for connection to each other;

the first end including a planar body defining a first aperture and a second aperture spaced apart from the first aperture;

the second end including a buckle having a body with a first protrusion configured to be received in the first aperture and a second protrusion configured to be received in the second aperture;

the first and second apertures both being defined on the first end of the elongated portion, and the buckle being connected on the opposed second end opposite the first end; and wherein the first end has a first free end, and the second aperture is closer to the first free end than is the first aperture, and wherein the second end has a second free end, and the second protrusion is closer to the second free end than is the first protrusion.

20. The belt of claim 19 wherein the first aperture has a first limit surface away from the second aperture, the second aperture has a second limit surface away from the first aperture, the distance between the first limit surface and the second limit surface comprising an aperture gap;

wherein the first and second protrusions extend in a common direction away from the body of the buckle, and the first protrusion having a first stop surface facing away from the second protrusion and adjacent to the body, the second protrusion having a second stop surface facing away from the first protrusion and adjacent to the body, the distance between the first and second stop surfaces defining a protrusion span; and the protrusion span being less than the aperture gap.

21. The belt of claim 20 wherein the first protrusion has a free end with a first nose extending away from the second protrusion and having a first nose free end, and the second protrusion having a second nose extending away from the first protrusion and having a second nose free end.

22. The belt of claim 19 wherein the buckle includes a strap mounting facility spaced apart from the first protrusion with the second protrusion therebetween.

23. The belt of claim 19 wherein the elongated portion has an inner surface including a hook and loop fastener component, such that an inner belt having an external compatible hook and loop fastener component is removably engaged.

24. The belt of claim 19 wherein the elongated portion includes a flexible laminated element.

* * * * *